US007699010B2

(12) United States Patent
Spade et al.

(10) Patent No.: US 7,699,010 B2
(45) Date of Patent: Apr. 20, 2010

(54) PERSONAL WATERCRAFT WITH DEFLECTOR

(75) Inventors: Sam Spade, Palm Bay, FL (US); Kirk Aguero, Indialantic, FL (US); Andre Cote, Longueuil (CA)

(73) Assignee: Bombardier Recreational Products Inc., Valcourt (CA)

( * ) Notice: Subject to any disclaimer, the term of this patent is extended or adjusted under 35 U.S.C. 154(b) by 8 days.

(21) Appl. No.: 12/023,734

(22) Filed: Jan. 31, 2008

(65) Prior Publication Data

US 2009/0194010 A1 Aug. 6, 2009

(51) Int. Cl.
*B63B 35/73* (2006.01)

(52) U.S. Cl. ..... 114/55.57; 114/364

(58) Field of Classification Search ..... 114/55.5, 114/55.52, 55.55, 55.57, 343, 364
See application file for complete search history.

(56) References Cited

U.S. PATENT DOCUMENTS 5,607,332 A * 3/1997 Kobayashi et al. ..... 114/55.57
5,957,072 A * 9/1999 Hattori ..... 114/55.57
6,413,130 B2 * 7/2002 Hattori ..... 440/88 R
6,578,508 B2 * 6/2003 Hattori et al. ..... 114/55.57
D516,006 S 2/2006 Bucaccio et al.
7,018,251 B2 * 3/2006 Iwakami et al. ..... 440/42
7,467,594 B1 * 12/2008 Duquette et al. ..... 114/55.5
2008/0110385 A1 * 5/2008 Nakatsuji et al. ..... 114/55.57

* cited by examiner

*Primary Examiner*—Lars A Olson
(74) *Attorney, Agent, or Firm*—Osler, Hoskin & Harcourt LLP

(57) ABSTRACT

A personal watercraft is disclosed having a hull and a sub-deck disposed on the hull. The hull and sub-deck together form a hull and sub-deck (HSD) assembly. An engine is disposed in the HSD assembly. A propulsion system is connected to the hull and operatively connected to the engine. A deck is disposed above the sub-deck. The deck has a pedestal. A straddle-type seat is disposed on the pedestal. A helm assembly is operatively connected to the propulsion system and disposed at least in part forwardly of the straddle-type seat. A deflector is disposed on the HSD assembly and extends outwardly therefrom. The deflector is disposed at least in part forwardly of a forward-most portion of the deck. A personal watercraft having only a hull and a deck is also disclosed.

14 Claims, 14 Drawing Sheets

PERSONAL WATERCRAFT WITH DEFLECTOR

FIELD OF THE INVENTION

The present invention relates to personal watercraft, in particular the geometry of a front portion of a watercraft.

BACKGROUND OF THE INVENTION

Most of today's commercially available personal watercraft have a hull and a deck disposed directly thereon. The deck has a pedestal onto which a straddle-type seat is disposed. While operating the watercraft, the driver and passengers sit on the seat and place their feet in footrests formed in recessed portions of the deck.

In an effort to minimize the transfer of these forces to the driver and passengers, some watercraft have a suspension element, such as a spring and damper assembly, disposed between the seat and the deck. Although this reduces the transfers of these forces to the body of the driver and passengers, this arrangement still tends to solicit the legs of the driver and passengers since the seat now moves relative to the footrests formed in the deck.

Another way to minimize the transfer of these forces to the driver and passengers consists in suspending the whole deck above the hull. The engine, fuel tank, and propulsion system are still in and/or connected to the hull. A sub-deck is disposed on the hull to protect the components in the hull from water. The hull and sub-deck together form a hull and sub-deck (HSD) assembly. The deck is suspended on the HSD assembly. In this arrangement, the footrest can still be formed with the deck, and as such the legs of the drivers and passengers are less solicited than in watercraft where only the seat is suspended. In this arrangement, the HSD assembly may have recesses designed to accommodate the footrests that are formed with the deck.

When recessed portions are formed in the HSD assembly for the purpose of providing footrests, these recessed portions are prone to filling up with water during operation of the watercraft. If the water is allowed to remain in the recessed portions, it can decrease rider comfort and affect the handling characteristics of the watercraft.

In addition, as water enters the watercraft it increases the weight of the watercraft, thereby reducing the buoyancy of the watercraft, which in turn lowers the watercraft relative to the water level and makes additional water more likely to enter the watercraft, thereby exacerbating the problem.

One of the ways in which water enters the recessed portions of the watercraft is by splashing up over the front portion of the watercraft while it is in operation. In addition to the drawbacks mentioned above, water entering the recessed portions over the front portion of the watercraft may splash up in front of the rider and cause reduced visibility and additional discomfort.

Therefore, there is a need for a personal watercraft having a deck and a HSD assembly, wherein the amount of water entering the HSD assembly during operation of the watercraft is reduced.

There is also a need for a personal watercraft having a hull and a deck, wherein the amount of water entering the deck during operation of the watercraft is reduced.

SUMMARY OF THE INVENTION

It is an object of the present invention to ameliorate at least some of the inconveniences present in the prior art.

It is also an object of the present invention to provide a personal watercraft having a deck and a HSD assembly, wherein the amount of water entering the HSD assembly during operation of the watercraft is reduced.

It is also an object of the present invention to provide a personal watercraft having a hull and a deck, wherein the amount of water entering the deck during operation of the watercraft is reduced.

In one aspect, the invention provides a personal watercraft comprising a hull. A sub-deck is disposed on the hull. The hull and sub-deck together form a hull and sub-deck (HSD) assembly. An engine is disposed in the HSD assembly. A propulsion system is connected to the hull and operatively connected to the engine. A deck is disposed above the sub-deck. The deck has a pedestal. A straddle-type seat is disposed on the pedestal. A helm assembly is operatively connected to the propulsion system and disposed at least in part forwardly of the straddle-type seat. A deflector is disposed on the HSD assembly and extends outwardly therefrom. The deflector is disposed at least in part forwardly of a forward-most portion of the deck.

In a further aspect, the HSD assembly further includes upwardly-extending left and right gunnels. At least one recessed portion is at least partially defined by the gunnels. The at least one recessed portion is disposed lower than an upper edge of the gunnels. The deflector is disposed at least in part forwardly of the at least one recessed portion.

In a further aspect, the deflector is disposed at least in part in front of the helm assembly.

In a further aspect, the deflector extends laterally along a majority of the width of the HSD assembly.

In a further aspect, the deflector has an upper end and a lower end. The upper end is disposed at least in part forwardly and upwardly of the lower end.

In a further aspect, the HSD assembly further includes a recessed portion disposed at least in part forwardly of the pedestal of the deck. The deflector is disposed at least in part forwardly of the recessed portion.

In a further aspect, the deflector extends laterally along substantially the entire width of the recessed portion.

In a further aspect, the deflector has an arcuate profile when viewed from the top.

In a further aspect, the deflector is disposed on the sub-deck.

In an additional aspect, a personal watercraft comprises a hull. A deck is disposed on the hull. The hull and the deck form an engine compartment therebetween. An engine is disposed in the engine compartment. A propulsion system is connected to the hull and operatively connected to the engine. A pedestal is formed in the deck. A straddle-type seat is disposed on the pedestal. A helm assembly is operatively connected to the propulsion system and disposed at least in part forwardly of the straddle-type seat. A deflector is disposed on the deck and extends outwardly therefrom. The deflector is disposed at least in part forwardly of a forward-most portion of the helm assembly.

In a further aspect, the deck further includes upwardly-extending left and right gunnels. At least one recessed portion is at least partially defined by the gunnels. The at least one recessed portion is disposed lower than an upper edge of the gunnels. The deflector is disposed at least in part forwardly of the at least one recessed portion.

In a further aspect, the deflector extends laterally along a majority of the width of the deck.

In a further aspect, the deflector has an upper end and a lower end. The upper end is disposed at least in part forwardly and upwardly of the lower end.

In a further aspect, the deck further includes a recessed portion disposed at least in part forwardly of the pedestal. The deflector is disposed at least in part forwardly of the recessed portion.

In a further aspect, the deflector extends laterally along substantially the entire width of the recessed portion.

In a further aspect, the deflector has an arcuate profile when viewed from the top.

For purposes of this application, terms related to spatial orientation such as forwardly, rearwardly, left, and right, are as they would normally be understood by a driver of the vehicle sitting thereon in a normal riding position.

Embodiments of the present invention each have at least one of the above-mentioned objects and/or aspects, but do not necessarily have all of them. It should be understood that some aspects of the present invention that have resulted from attempting to attain the above-mentioned objects may not satisfy these objects and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION OF THE PREFERRED EMBODIMENTS

Figure 5:
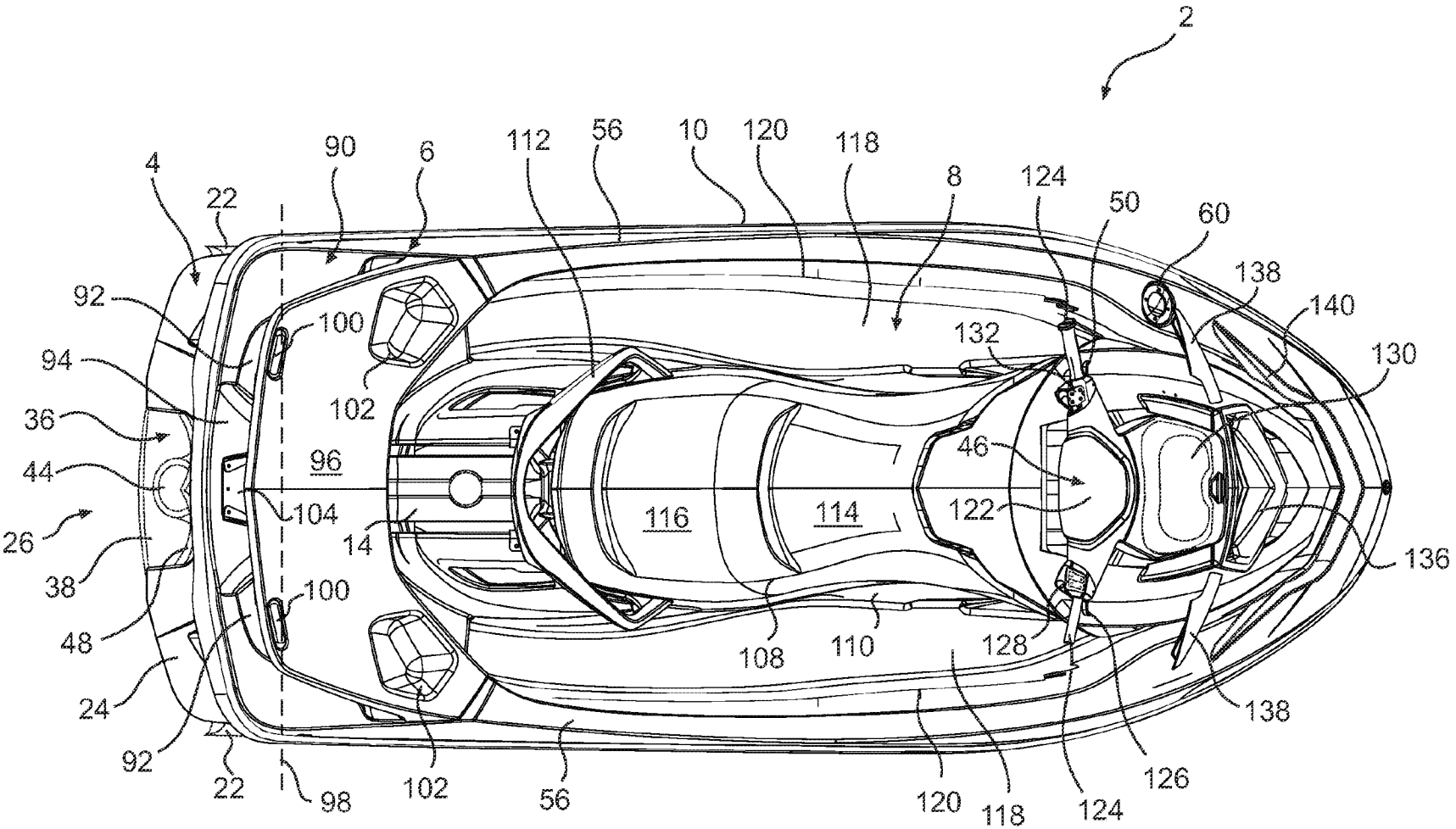
FIG. 5 is a perspective view, taken from a top, rear side, of the watercraft of FIG. 1.
Figure 6:
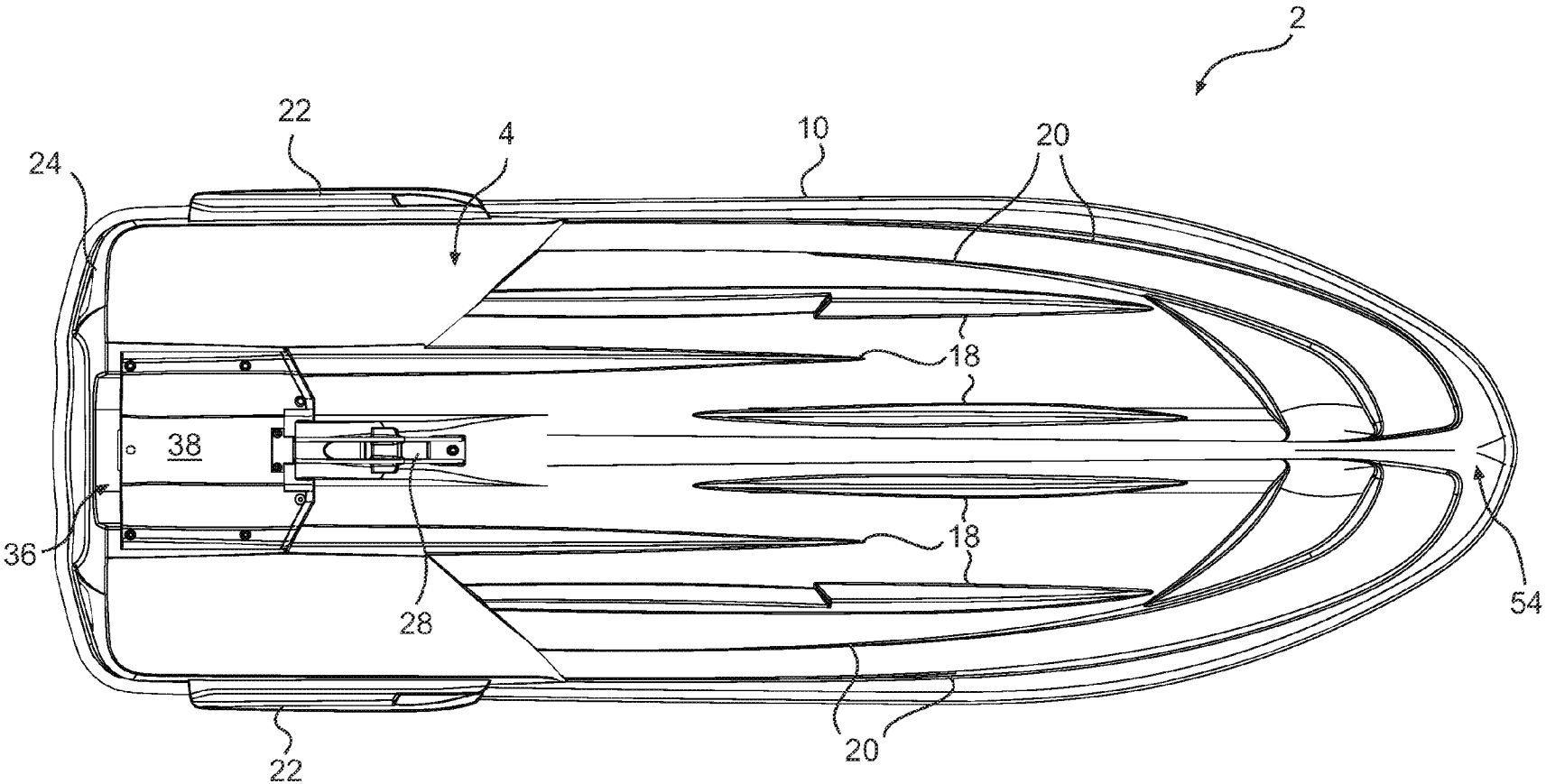
FIG. 6 is a bottom plan view of the watercraft of FIG. 1.
Figure 7:
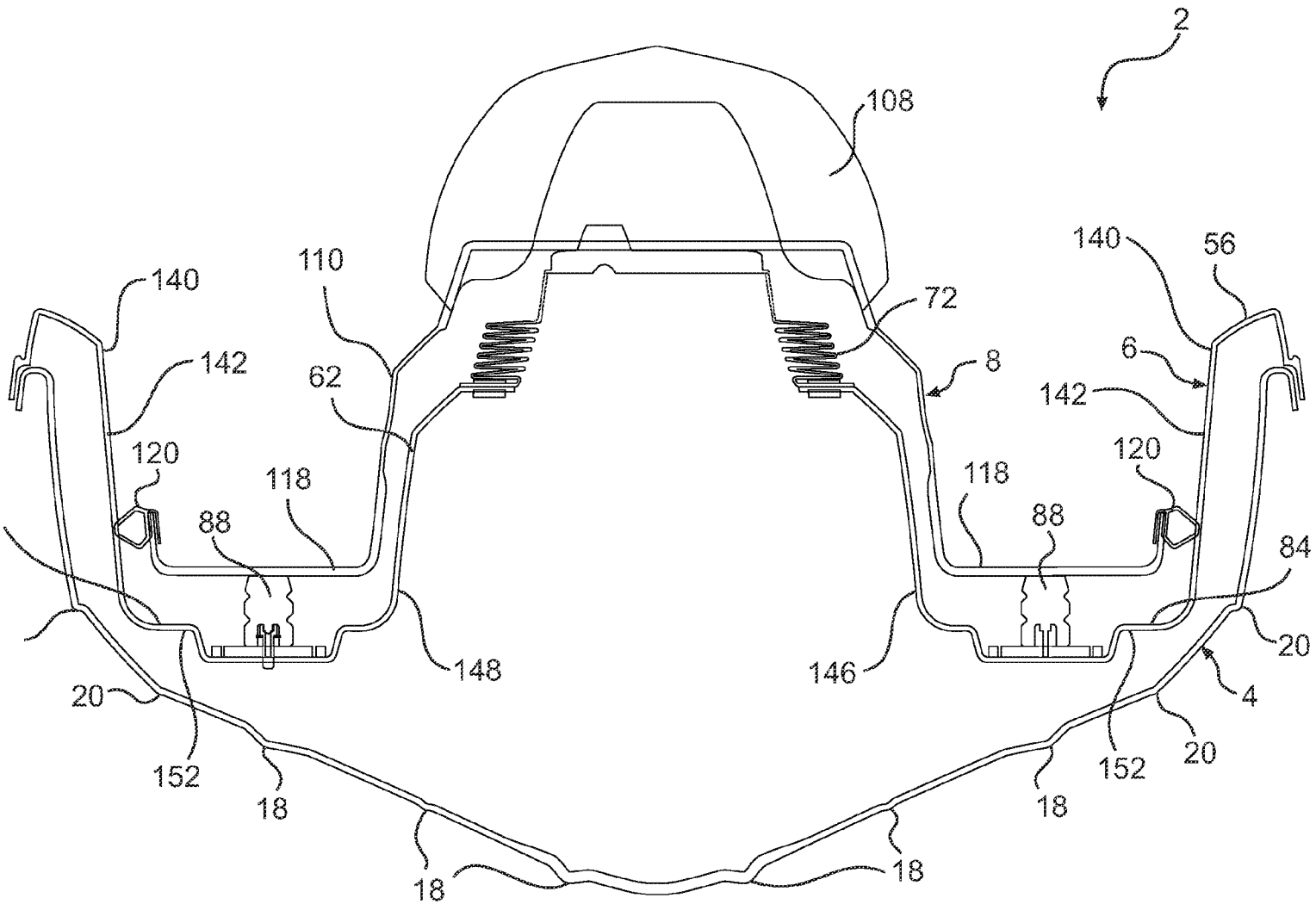
FIG. 7 is a schematic view of a transverse cross-section of the watercraft of FIG. 1.
Figure 8:
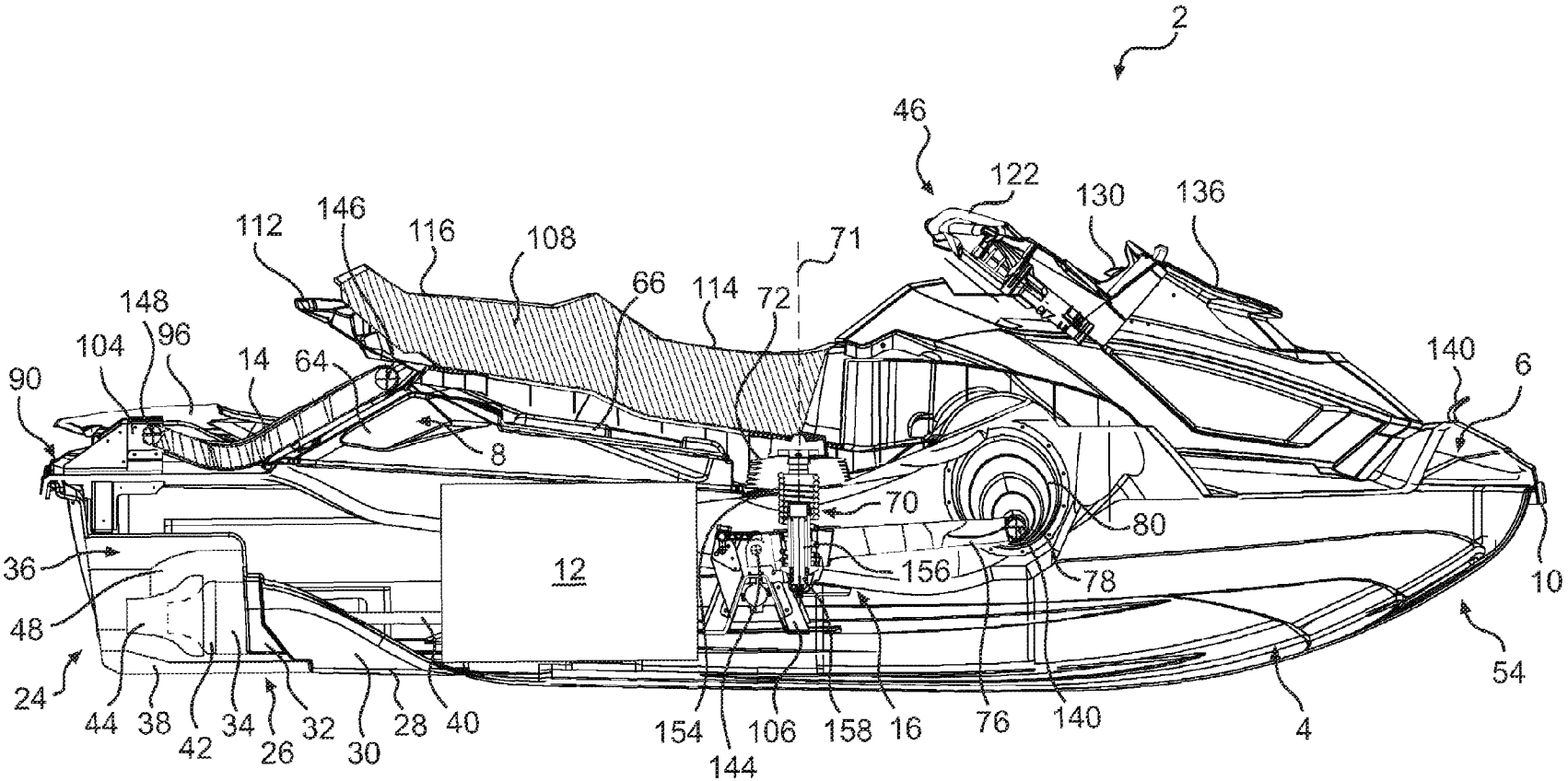
FIG. 8 is a partial longitudinal cross-section of the watercraft of FIG. 1 showing some of the internal components thereof.
Figure 9:
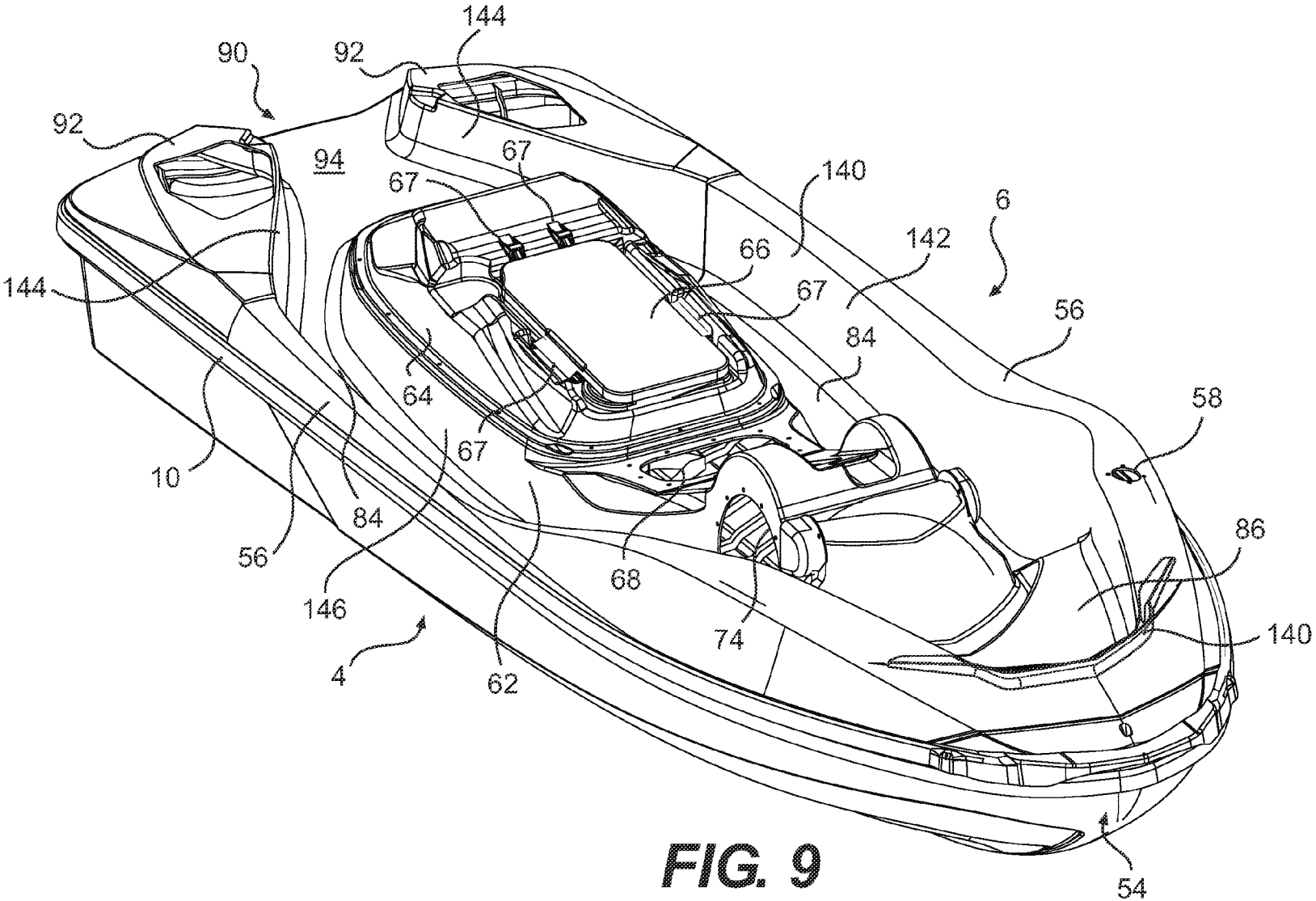
FIG. 9 is a perspective view, taken from a front, right side, of a hull and sub-deck assembly of the watercraft of FIG. 1, with the engine cowling thereon.
Figure 10:
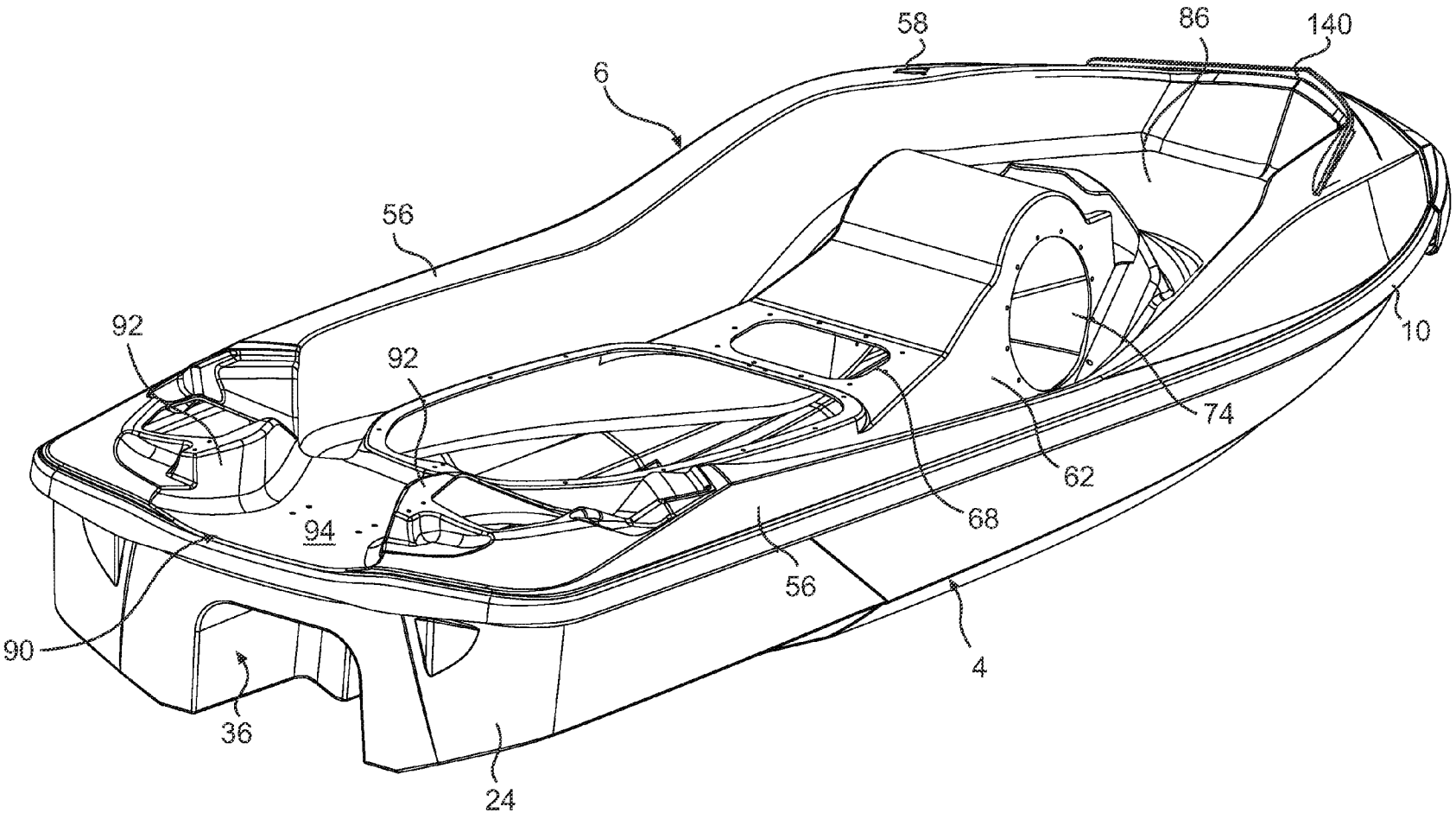
FIG. 10 is a perspective view, taken from a rear, right side, of the hull and sub-deck assembly of FIG. 9, with the engine cowling removed.
Figure 11:
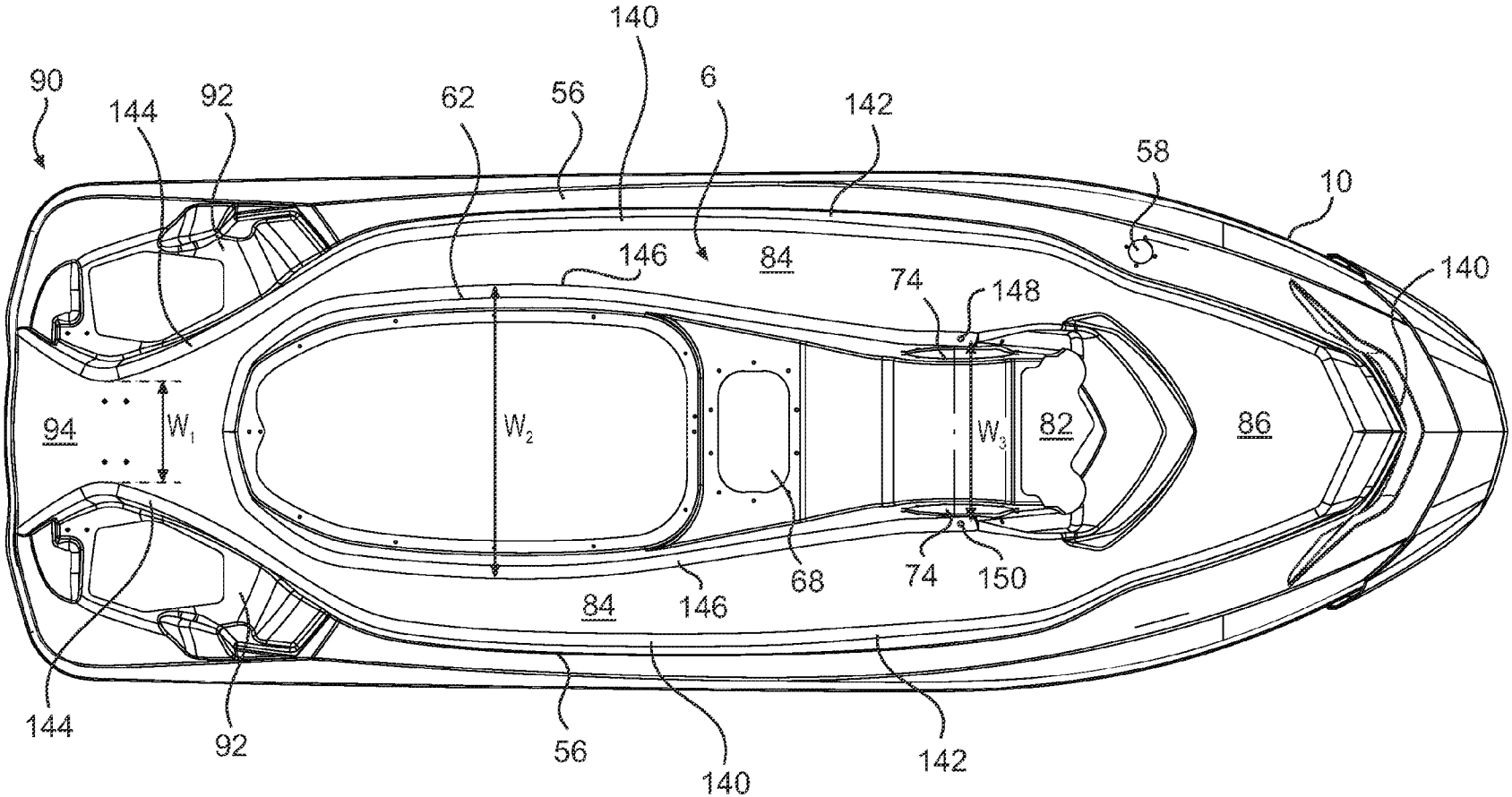
FIG. 11 is a top plan view of the hull and sub-deck assembly of FIG. 9, with the engine cowling removed.

Turning to FIGS. 1 to 12, a personal watercraft 2 will be described. The watercraft 2 is made of three main parts. These parts are the hull 4, the sub-deck 6, and the deck 8. As best seen in FIGS. 9 to 11, the hull 4 and sub-deck 6 are joined together, preferably by an adhesive, to form a hull and sub-deck (HSD) assembly. Rivets or other fasteners may also join the hull 4 and sub-deck 6. A bumper 10 generally covers the joint helping to prevent damage to the outer edge of the watercraft 2 when the watercraft 2 is docked. The volume created between the hull 4 and the sub-deck 6 is known as the engine compartment. The engine compartment accommodates the engine 12 (schematically shown in FIG. 8) as well as the muffler, exhaust pipe, gas tank, electrical system (including for example a battery and an electronic control unit), air box, storage bins (not shown) and other elements required by or desired for the watercraft 2. The deck 8 (FIG. 3) is designed to accommodate a driver and one or more passengers. As best seen in FIGS. 7 and 8, the deck 8 is suspended on the HSD assembly by a rear suspension member in the form of a rear suspension arm 14 and a front suspension assembly 16 described in greater detail below. It is contemplated that the deck 8 could be fixedly connected to the HSD assembly.

Figure 1:
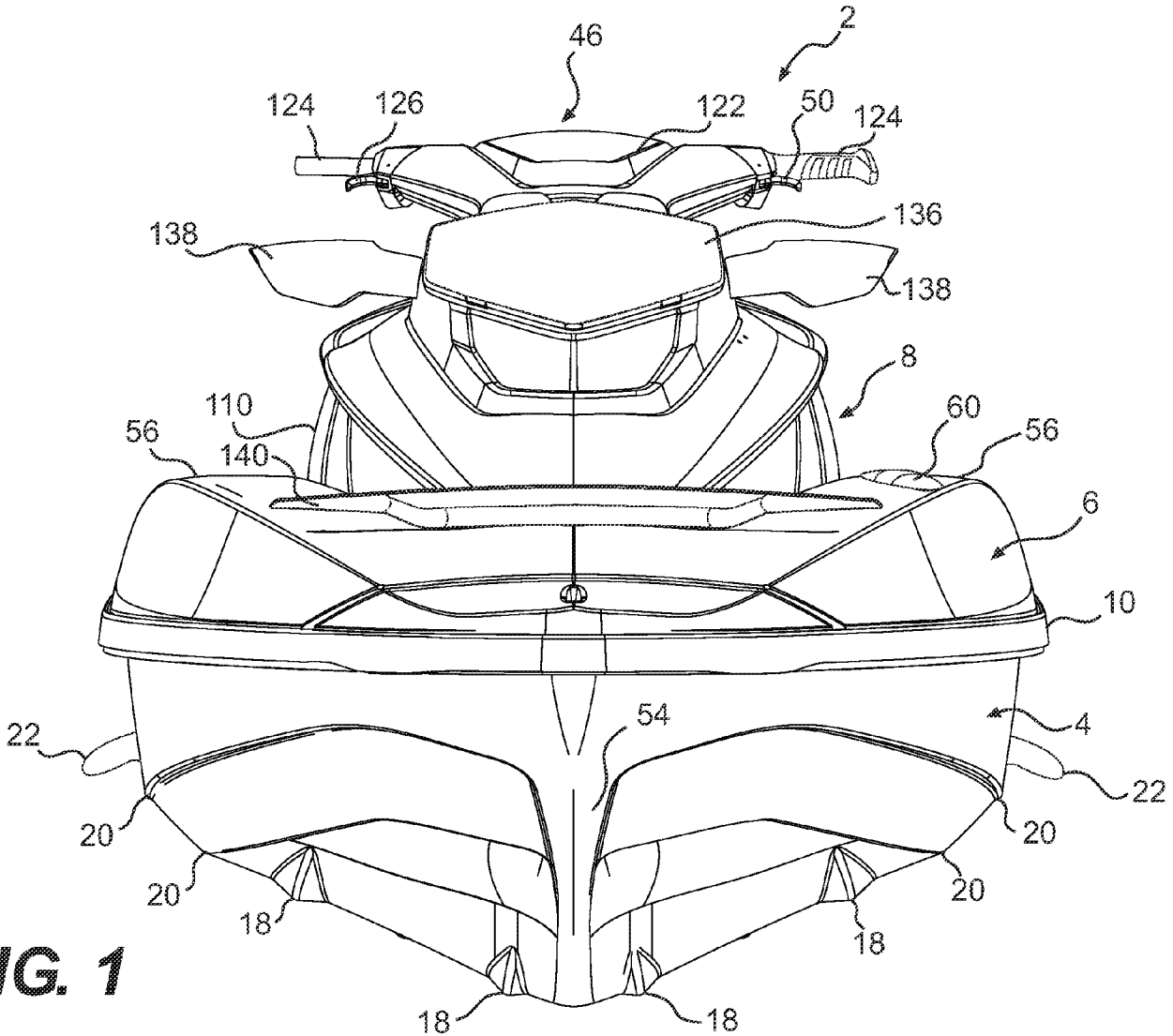
FIG. 1 is a front elevation view of a personal watercraft according to the present invention.

As best seen in FIGS. 1 and 6, the hull 4 is provided with a combination of strakes 18 and chines 20. A strake 18 is a protruding portion of the hull 4. A chine 20 is the vertex formed where two surfaces of the hull 4 meet. It is this combination of strakes 18 and chines 20 that will give, at least in part, the watercraft 2 its riding and handling characteristics.

Sponsons 22 are located on either side of the hull 4 near the transom 24. The sponsons 22 have an arcuate undersurface, which give the watercraft 2 both lift while in motion and improved turning characteristics.

Figure 2:
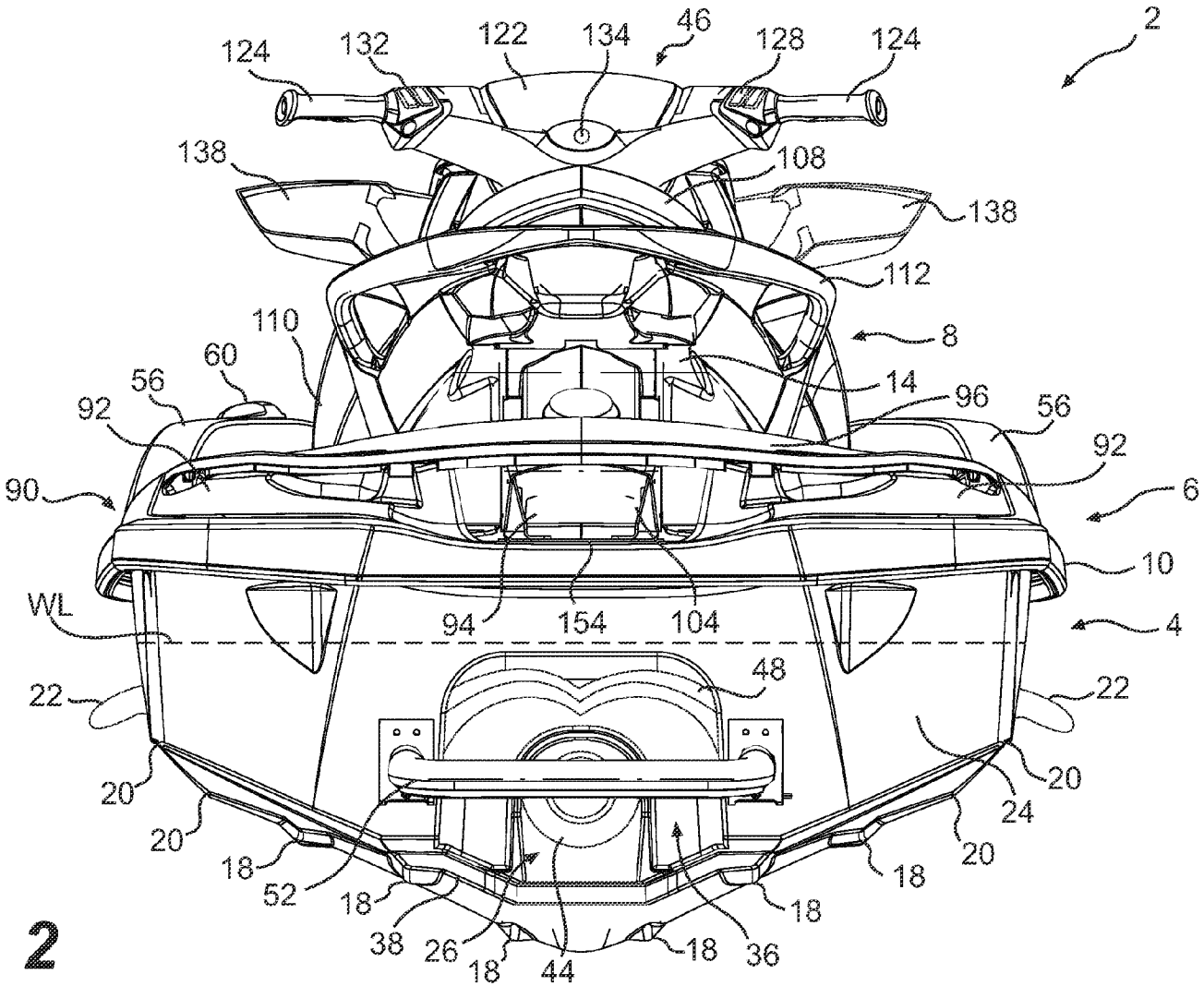
FIG. 2 is a rear elevation view of the watercraft of FIG. 1.
Figure 3:
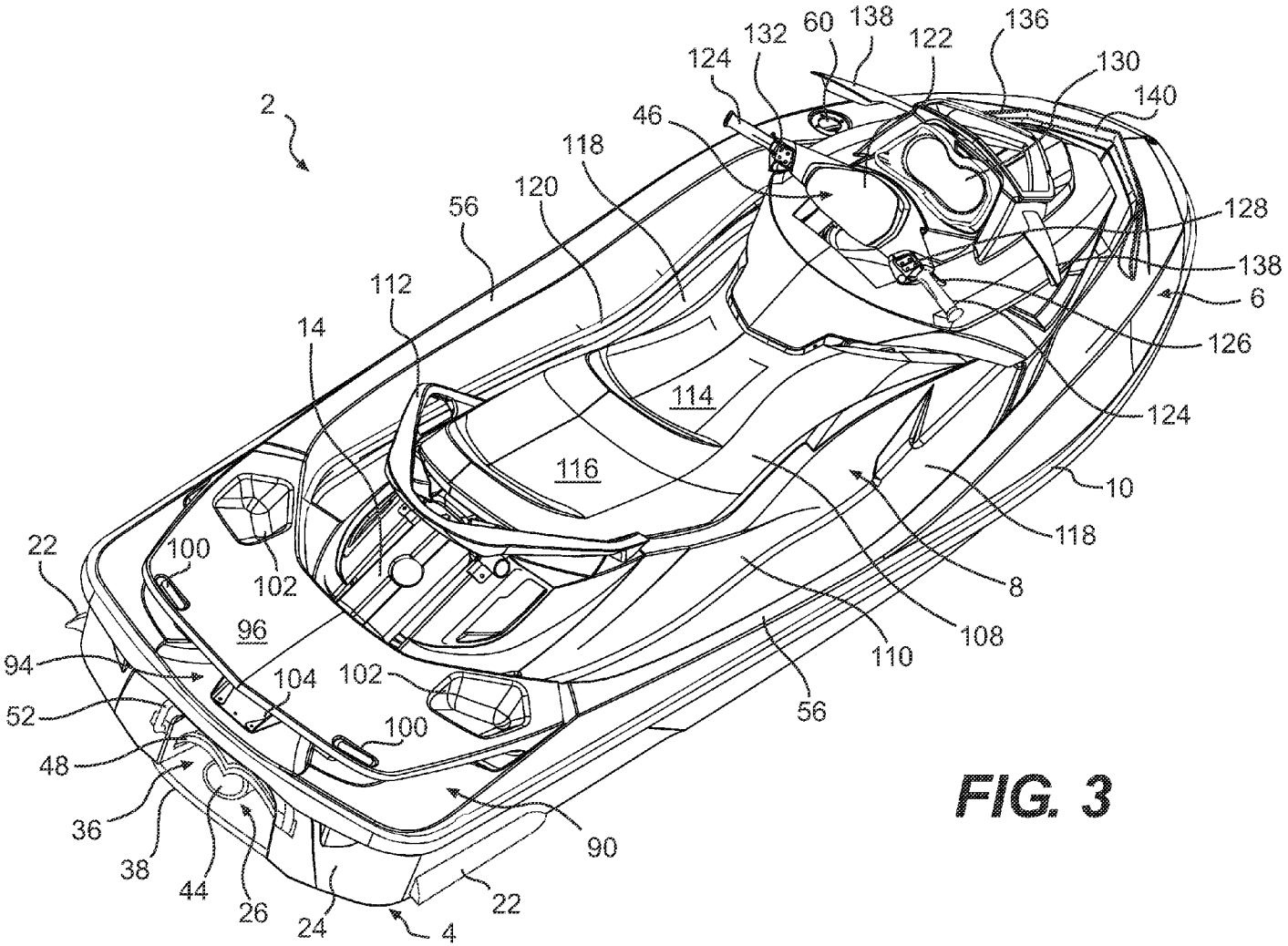
FIG. 3 is a perspective view, taken from a rear, right side, of the watercraft of FIG. 1.
Figure 4:
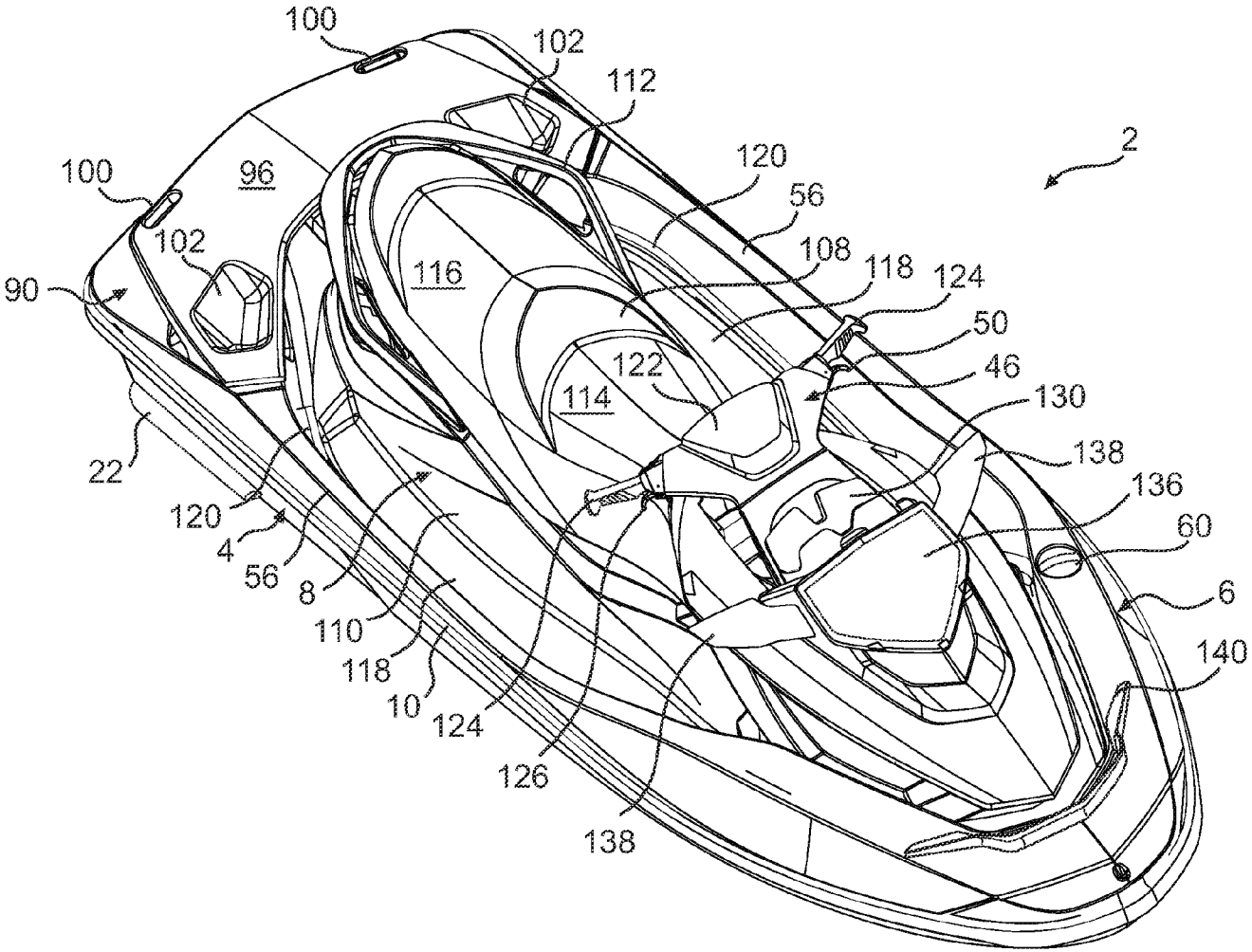
FIG. 4 is a perspective view, taken from a front, right side, of the watercraft of FIG. 1.

As best seen in FIGS. 2 and 8, a jet propulsion system 26 is connected to the hull 4. The jet propulsion system 26 pressurizes water to create thrust. The water is first scooped from under the hull 4 through the inlet grate 28 (FIG. 6). The inlet grate 28 prevents large rocks, weeds, and other debris from entering the jet propulsion system 26 since they may otherwise damage it or negatively affect its performance. Water then flows through a water intake ramp 30. The top portion of the water intake ramp 30 is formed by hull 4 and a ride shoe 32 forms its bottom portion. Alternatively, the intake ramp 30 may be a single piece to which a jet pump unit 34 attaches. In such cases, the intake ramp 30 and the jet pump unit 34 are attached as a unit in a recess in the bottom of hull 4. From the intake ramp 30, water then enters the jet pump unit 34. The jet pump unit 34 is located in what is known as the tunnel 36. The tunnel 36 is opened towards the rear, is defined at the front, sides, and top by the hull 4, and at the bottom by a ride plate 38. The ride plate 38 is the surface on which the watercraft 2 rides or planes. The jet pump unit 34 includes an impeller and a stator (not shown) enclosed in a cylindrical housing. The impeller is coupled to the engine 12 by one or more shafts 40, such as a driveshaft and an impeller shaft. The rotation of the impeller pressurizes the water, which then moves over the stator that is made of a plurality of fixed stator blades (not shown). The role of the stator blades is to decrease the rotational motion of the water so that almost all the energy given to the water is used for thrust, as opposed to swirling the water. Once the water leaves the jet pump unit 34, it goes through the venturi 42. Since the venturi's exit diameter is smaller than its entrance diameter, the water is accelerated further, thereby providing more thrust. A steering nozzle 44 is pivotally attached to the venturi 42 about a vertical pivot axis. The steering nozzle 44 is operatively connected to a helm assembly 46 disposed on the deck 8 via a push-pull cable (not shown) such that when the helm assembly 46 is turned, the steering nozzle 44 pivots, redirecting the water coming from the venturi 42, so as to steer the watercraft 2 in the desired direction. It is contemplated that the steering nozzle 44 may be gimbaled to allow it to move about a second horizontal pivot axis (not shown). The up and down movement of the steering nozzle 44 provided by this additional pivot axis is known as trim, and controls the pitch of the watercraft 2. It is contemplated that other types of propulsion systems, such as a propeller, could be used.

A reverse gate 48 is pivotally attached to the sidewalls of the tunnel 36. It is contemplated that the reverse gate 48 could alternatively be pivotally attached to the venturi 42 or the steering nozzle 44. The reverse gate 48 is operatively connected to an electric motor (not shown) and the driver of the watercraft can control the position of the reverse gate 48 by pulling lever 50 (FIG. 1) located on the left side of the helm assembly 46 which is in electrical communication with the electric motor. It is contemplated that the reverse gate 48 could alternatively be mechanically connected to a reverse handle to be pulled by the driver. To make the watercraft 2 move in a reverse direction, the reverse gate 48 is pivoted in front of the steering nozzle 44 and redirects the water leaving the jet propulsion system 26 towards the front of the watercraft 2, thereby thrusting the watercraft 2 rearwardly.

A retractable ladder 52, best seen in FIG. 2 in its lowered position, is affixed to the transom to facilitate boarding 24 the watercraft 2 from the water.

Hooks (not shown) are located on the bow and transom 24 of the watercraft 2. These hooks are used to attach the watercraft 2 to a dock when the watercraft 2 is not in use or to a trailer when the watercraft 2 is being transported outside the water.

When the watercraft 2 is in movement, its speed is measured by a speed sensor (not shown) attached to the transom 24 of the watercraft 2. The speed sensor has a paddle wheel which is turned by the flow of water, therefore the faster the watercraft 2 goes, the faster the paddle wheel turns. An electronic control unit (not shown) connected to the speed sensor converts the rotational speed of the paddle wheel to the speed of the watercraft 2 in kilometers or miles per hour, depending on the driver's preference. The speed sensor may also be placed in the ride plate 38 or any other suitable position. Other types of speed sensors, such as pitot tubes, could also be used. It is also contemplated that the speed of the watercraft 2 could be determined from input from a GPS mounted to the watercraft 2.

Turning now to FIGS. 7 to 11, features of the sub-deck 6 will be described. The sub-deck 6 has a pair of generally upwardly extending walls located on either side thereof known as gunwales or gunnels 56. The gunnels 56 help to prevent the entry of water in the watercraft 2 and also provide buoyancy when turning the watercraft 2, since the watercraft 2 rolls slightly when turning. A refuelling opening 58 is provided on the front left gunnel 56. A hose (not shown) extends from the refuelling opening 58 to the fuel tank (not shown) disposed near the bow 54 in the volume formed between the hull 4 and the sub-deck 6. This arrangement allows for refilling of the fuel tank. A fuel cap 60 (FIG. 1) is used to sealingly close the refuelling opening 58, thereby preventing water from entering the fuel tank when the watercraft 2 is in use.

A pedestal 62 is centrally positioned on the sub-deck 6. The pedestal 62 accommodates the internal components of the watercraft 2, such as the engine 12, and shields these components from water. A portion of the rear of the pedestal 62, known as the engine cowling 64 (FIG. 9) can be removed to permit access to the engine 12. The engine cowling 64 is fastened to the remainder of the sub-deck 6. The top portion of the engine cowling 64 is closed by a removable air intake unit 66. The air intake unit 66 is attached to the pedestal 62 by clips 67. The air intake unit 66 incorporates a system of arcuate passages and baffles which permit air to enter the volume between the hull 4 and the sub-deck 6, and thus be supplied to the engine 12, while reducing the likelihood of water entering that volume. Air enters around the sides of the air intake unit 66, goes through the passages and baffles therein, and then goes down a tube connected to the bottom of the air intake unit 66 and opening near the bottom of the hull 4. Removal of the air intake unit 66 permits access to elements located near the top of the engine 12 which need to be accessed more regularly, such as spark plugs (not shown) or the oil dipstick (not shown). A tow hook (not shown) is provided on the rear portion of the pedestal 62 below the engine cowling 64 to provide an attachment point for towing a water-skier or an inflatable device for example.

An opening 68 is provided in the upper portion of the pedestal 62 forwardly of the engine cowling 64 to permit suspension elements 70 (FIG. 8) of the front suspension assembly 16 to pass therethrough. The suspension elements 70 absorb the loads as the HSD assembly moves relative to the deck 8 and dampen the motion. The suspension elements 70 can include, but are not limited to, one or more springs and a hydraulic damper. It is contemplated that the suspension assembly 16 could include a single suspension element. A bellows 72 (FIG. 8) is sealed around the opening 68 at a lower end thereof and is connected to the deck 8 at an upper end thereof to prevent water from entering the opening 68 while permitting relative movement between the sub-deck 6 and the deck 8. Two openings 74 are provided on the sides of the pedestal 62 forwardly of the opening 68. As seen in FIGS. 8 and 9, these openings 74 allow a front suspension member of the front suspension assembly 16 to be pivotally connected to the deck 8. More specifically, the front suspension member includes a front suspension arm 76 and a shaft 78, and the upper end of the front suspension arm 76 is connected to the shaft 78 which extends through the openings 74 to pivotally connect to the deck 8. It is contemplated that the front suspension member could be made of a single part or that it could be made of more parts. Bellows 80 are connected to the sub-deck 6 around the openings 74 at one end thereof and are connected around brackets (not shown) that are attached to the shaft 78 at the other end thereof. The bellows 80 thus seal and prevent water from entering the openings 74 while permitting relative movement between the sub-deck 6 and the deck 8. Another opening 82 (best seen in FIG. 11) is located in the sub-deck 6 forwardly of the openings 74. Opening 82 allows the passage of two air intake tubes (not shown). Each intake tube has one end opened to a side of the pedestal 62 (one on each side), extends laterally to the other side of the pedestal 62, then moves down near the bottom of the hull 4, thus reducing the likelihood of water entering therethrough in case the watercraft 2 were to flip over. The deck 8 disposed on top of the sub-deck 6 also helps to prevent water from entering the various openings 68, 74, the air intake unit 66, and the air intake tubes by shielding them from direct exposure to water during normal operation. Should any water enter the volume between the hull 4 and the sub-deck 6, it will pool at the bottom of the hull 4 where it will be evacuated by a bilge system (not shown) as is know in the art.

As best seen in FIGS. 7 and 11, side channels 84 are formed between the gunnels 56 and the pedestal 62. The side channels 84 communicate with a recess 86 forward of the pedestal 62. The side channels 84 and the recess 86 receive the lower portions of the deck 8 and permit relative movement between the deck 8 and the sub-deck 6. Rubber mounts 88 (FIG. 7) are connected to the bottom of the side channels 84 to limit the relative movement of the sub-deck 6 towards the deck 8, and thus absorbing some of the impact should they come into contact.

A rear portion 90 of the sub-deck 6 is disposed higher than a bottom of the side channels 84. The rear portion 90 is high enough that, when the watercraft 2 is at rest and under normal loading conditions (i.e. no excess passengers or cargo), the rear portion 90 is disposed above the waterline thus preventing water from infiltrating into the side channels 84 from the back of the watercraft 2. The rear portion 90 has a raised portion on each side thereof forming storage compartments 92. The volume formed by the storage compartments 92 increases the buoyancy of the watercraft 2 and therefore, the lateral stability thereof. A rear channel 94 is formed between the two storage compartments 92. The rear channel 94 is disposed on a lateral center of the sub-deck 6 and its width is selected such that when the watercraft 2 turns (and therefore tilts) water will not enter the side channels 84 from the rear channel 94. When the watercraft 2 moves forward, the bow 54 raises, thus raising the side channels 84. This permits any water accumulated in the side channels 84 to drain through the rear channel 94.

Figure 12:
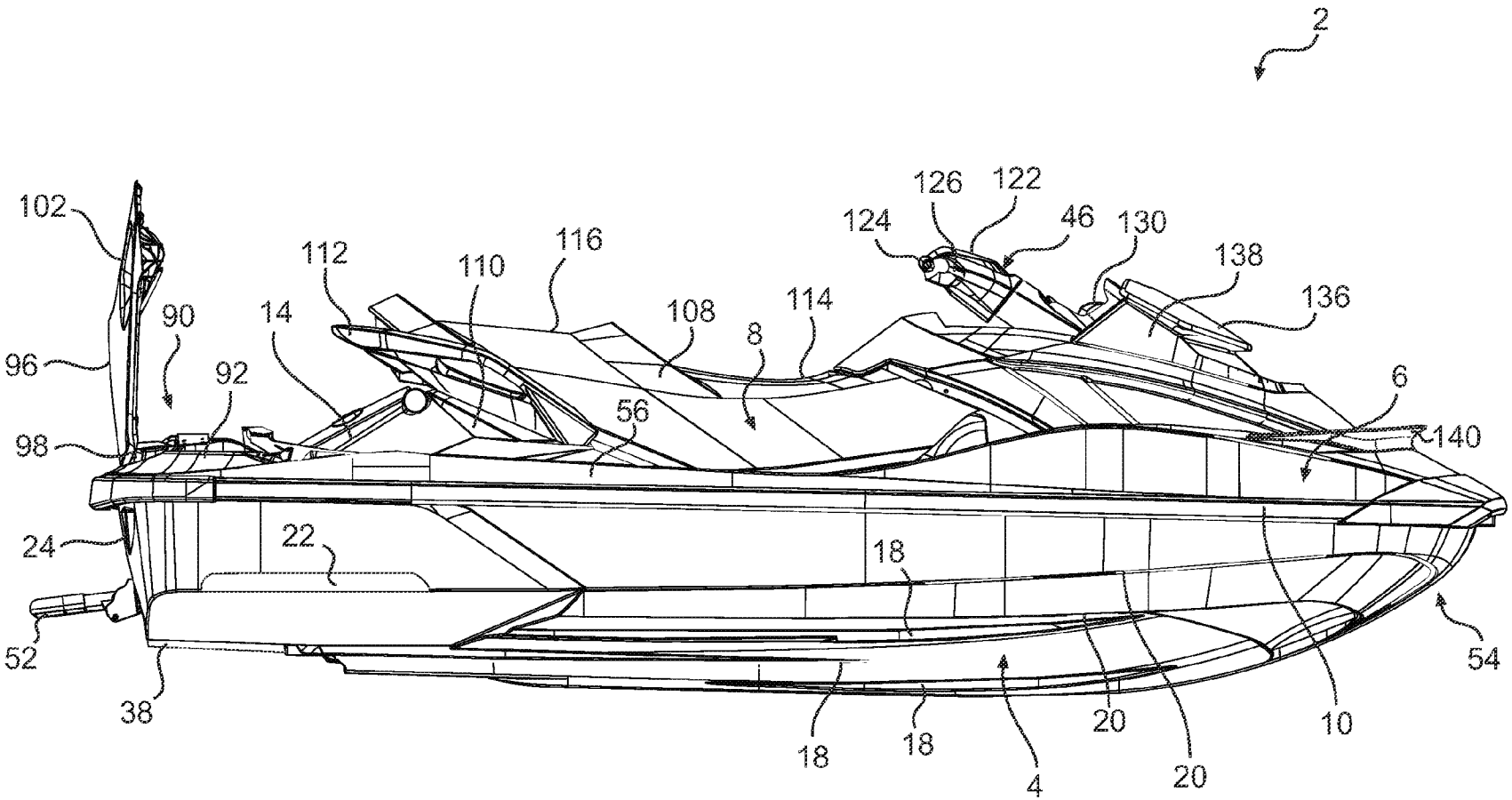
FIG. 12 is a side elevation view of the watercraft of FIG. 1 with a rear platform thereof in a raised position.

A rear platform 96 is pivotally connected on the rear portion 90 of the sub-deck 6. The platform 96 preferably pivots about an axis 98 (FIGS. 5 and 12) located near the transom 24 and extending laterally across the sub-deck 6. It is contemplated that the platform 96 could alternatively pivot about an axis located near the front of thereof and extending laterally across the sub-deck 6. It is also contemplated that the platform 96 could alternatively pivot about an axis extending generally parallel to a longitudinal axis of the watercraft 2 and disposed near a lateral side of the platform 96. When the rear platform 96 is in a raised position, as shown in FIG. 12, it permits access to the storage compartments 92. When the rear platform 96 is in a lowered, horizontal position, as shown in FIGS. 2 to 5, the rear platform 96 closes and seals the storage compartments 92, thus eliminating the need of separate lids to accomplish this function. In the lowered position, the rear platform 96 provides a surface on which the driver or passengers can stand when the watercraft 2 is at rest. Two recesses in the rear platform 96 form hand grips 100 which a person can grab to assist themselves when reboarding the watercraft 2 from the water. Two more recesses in the rear platform 96 form heel rests 102 which a passenger sitting on the watercraft 2 facing rearwardly, for spotting a water-skier being towed by the watercraft 2 for example, can use to place their heels to provide them with additional stability. Carpeting made of a rubber-type material preferably covers the rear platform 96 to provide additional comfort and feet traction on the rear platform 96.

Turning back to FIGS. 1 to 8, the deck 8 of the watercraft 2 will be described. As previously mentioned, the deck 8 is suspended on the HSD assembly. As seen in FIG. 8, the rear portion of the deck 8 is pivotally connected to the upper end of the rear suspension arm 14. The rear suspension arm 14 extends downwardly and rearwardly from its connection to the rear portion of the deck 8 and the lower end of the rear suspension arm 14 pivotally connects to a bracket 104 on the rear portion 90 of the sub-deck 6. It is contemplated that the bracket 104 could be disposed inside the volume between the hull 4 and the sub-deck 6, with the addition of an opening in the rear portion 90 of the sub-deck 6 and of a bellows similar to bellows 80 extending between the opening and the rear suspension arm 14 to prevent the intrusion of water in the watercraft 2. The front portion of the deck 8 is connected to the front suspension assembly 16. The front portion of the deck 8 is connected, via shaft 78, to the upper end of the front suspension arm 76. The front suspension arm 76 extends downwardly and rearwardly from its connection to the front portion of the deck 8 and the lower end of the front suspension arm 76 pivotally connects to a bracket 106 on the bottom of the hull 4. Suspension elements 70 are connected at their lower ends to the front suspension arm 76 forwardly of the bracket 106 and extend upwardly to connect to the under side of the deck 8 at their upper ends. The force absorption characteristics of the suspension elements 70 can be adjusted by the driver of the watercraft 2 to take into account the load on the deck 8 (i.e. the presence or absence of passengers and/or cargo) and/or to change the riding characteristics of the watercraft 2. The geometry of the rear and front suspension arms 14, 76 is such that as the watercraft 2 moves on the water, the HSD assembly will move rearwardly and upwardly relative to the deck 8 as it encounters waves, thus absorbing the impact thereby providing a more comfortable ride for the driver and passengers, if applicable, since the deck 8 will be more stable.

As seen in FIGS. 1 to 5, the deck has a centrally positioned straddle-type seat 108 placed on top of a pedestal 110 to accommodate the driver and passengers in a straddling position. A grab handle 112 is provided between the pedestal 110 and the straddle-type seat 108 at the rear of the straddle-type seat 108 to provide a handle onto which a passenger may hold on. The straddle-type seat 108 has a first seat portion 114 to accommodate the driver and second seat portion 116 to accommodate one or two passengers. The seat 108 is pivotally connected to the pedestal 110 at the front thereof by a system of linkages and is connected at the rear thereof by a latch assembly (not shown). The seat 108 selectively covers an opening (not shown), defined by a top portion of the pedestal 110, which provides access to the air intake unit 66, which once removed, provides access to the upper portion of the engine 12.

Located on either side of the pedestal 110, between the pedestal 110 and the gunnels 56 of the sub-deck 6, are a pair of generally horizontal footrests 118 designed to accommodate the driver's and passengers' feet. By having the footrests 118 form part of the deck 8, the legs of the driver and passengers are not moving with the HSD assembly, and therefore the driver's and passengers' legs are not solicited to absorb part of the impact between the watercraft 2 and the waves. As best seen in FIGS. 5 and 7, a seal 120 is disposed between each footrest 118 and its corresponding gunnel 56 on the sub-deck 6. The seals 120 do not need to make the space between the footrests 118 and the gunnels 56 watertight since any water that enters in the side channels 84 located below can be evacuated through the rear channel 94. The seals 120 are there to prevent objects from falling through that space and then falling in the side channels 84, which would make these objects difficult to recover without removing the deck 8. Since an upper end of the side channels 84 is wider than a lower end of the side channels 84, the seals 120 are preferably made of a flexible material, such as rubber, that can compress and expand to follow the inner side of the gunnels 56 as the HSD assembly moves relative to the deck 8. The footrests 118 are preferably covered by carpeting made of a rubber-type material to provide additional comfort and feet traction.

As best seen in FIGS. 2 and 5, the helm assembly 46 is positioned forwardly of the straddle-type seat 108. As previously mentioned, the helm assembly 46 is used to turn the steering nozzle 44, and therefore the watercraft 2. The helm assembly 46 has a central helm portion 122 that may be padded, and a pair of steering handles 124. The right steering handle 124 is provided with a throttle lever 126 allowing the driver to control the speed of the watercraft 2. The left steering handle is provided with a lever 50 to control the position of the reverse gate 48, as previously mentioned. The central helm portion 122 has buttons 128 that allow the driver to modify what is displayed (such as speed, engine rpm, and time) on the display cluster 130 located forwardly of the helm assembly 46. Additional buttons 132 are provided on the helm portion 122 to allow the driver to adjust the force absorption characteristics of the suspension elements 70. The helm assembly 46 is also provided with a key receiving post 134 near a center thereof. The key receiving post 134 is adapted to receive a key (not shown) attached to a lanyard (not shown) so as to allow starting of the watercraft 2. It should be noted that the key receiving post 134 may alternatively be placed in any suitable location on the watercraft 2. The helm assembly 46 is preferably pivotable about a horizontal axis to allow the height of the helm assembly 46 to be adjusted to suit the driver's preference. The display cluster 130 also preferably moves about the horizontal axis with the helm assembly 46.

The deck 8 is provided with a hood 136 located forwardly of the helm assembly 46. A hinge (not shown) is attached between a forward portion of the hood 136 and the deck 8 to allow hood 136 to move to an opened position to provide access to a front storage bin (not shown). A latch (not shown) located at a rearward portion of hood 136 locks hood 136 into a closed position. When in the closed position, hood 136 prevents access to the front storage bin. Rearview mirrors 138 are positioned on either side of hood 136 to allow the driver to see behind the watercraft 2 while driving.

Figure 13:
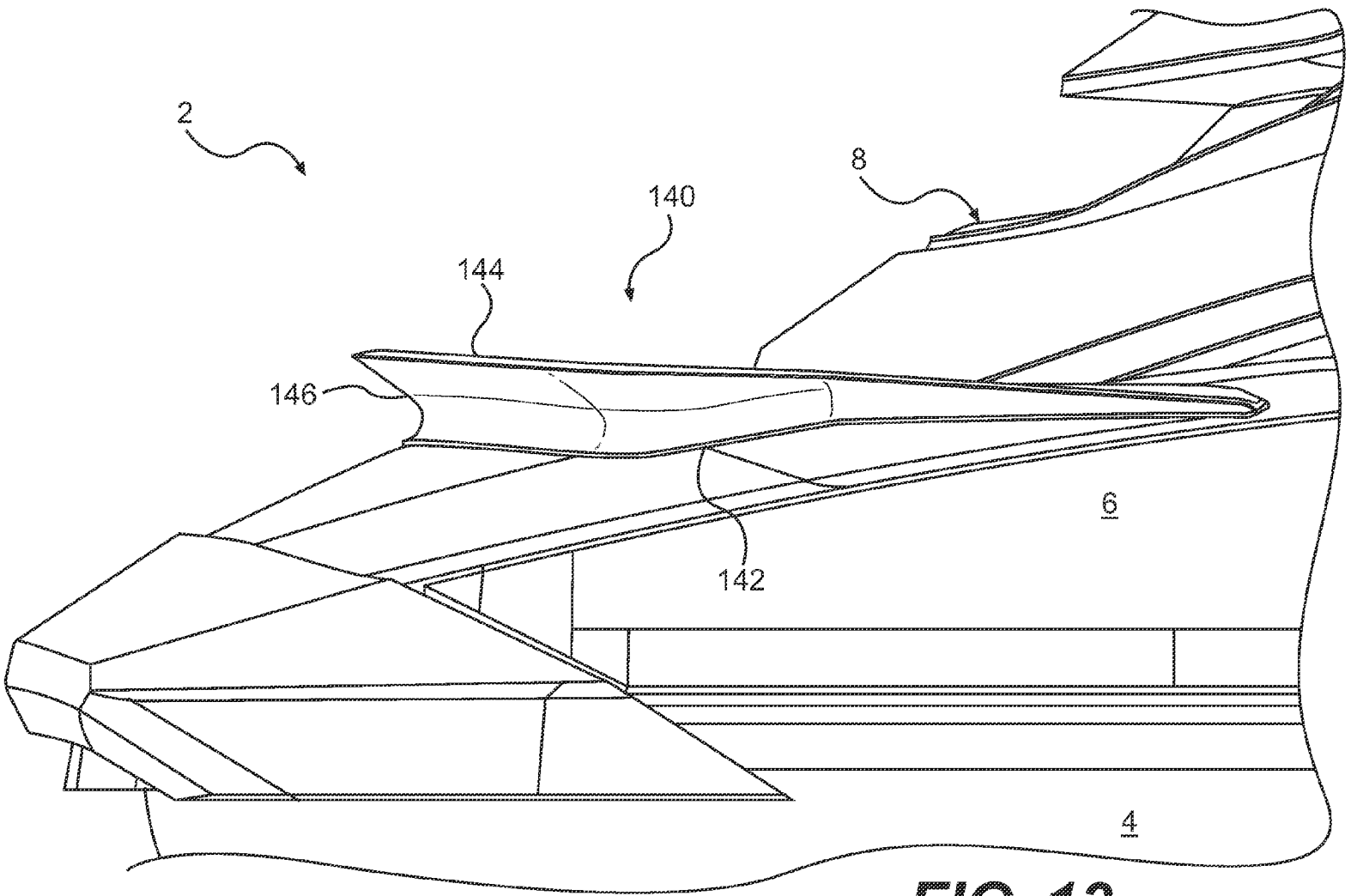
FIG. 13 is a side elevation view of a front portion of the watercraft of FIG. 1, showing the deflector.

Referring to FIG. 13 and referring back to FIGS. 1, 3-5 and 8-12, a deflector 140 is disposed on the forward portion of the sub-deck 6 and extends outwardly therefrom. The deflector 140 has an arcuate profile when viewed from above (FIGS. 5, 11). The deflector 140 has a lower end 142 where the deflector 140 meets the sub-deck 6, and an upper end 144 corresponding to the top of the deflector 140. The lower end 142 and the upper end 144 define therebetween an arcuate front face 146 of the deflector 140 (FIG. 13). An upper portion of the deflector 140 is angled forwardly and upwardly, such that the upper end 144 is disposed at least in part forwardly and upwardly of the lower end 142. The deflector is positioned at least in part in front of areas of the watercraft 2 where it is desired to prevent or reduce the entry of water, such as the side channels 84 and the recess 86 forward of the pedestal 62. In this position, the deflector 140 is additionally positioned at least in part in front of the deck 8, including the helm assembly 46. The width of the deflector 140 in a transverse direction of the watercraft 2 is a majority of the width of the HSD assembly, and in particular the deflector 140 extends along substantially the width of the side channels 84 and the recess 86 to reduce water entry therein. It is contemplated that the deflector 140 may alternatively be formed by a number of separate, smaller deflector portions whose total effective width is sufficient to reduce water entry into the watercraft 2.

Figure 14:
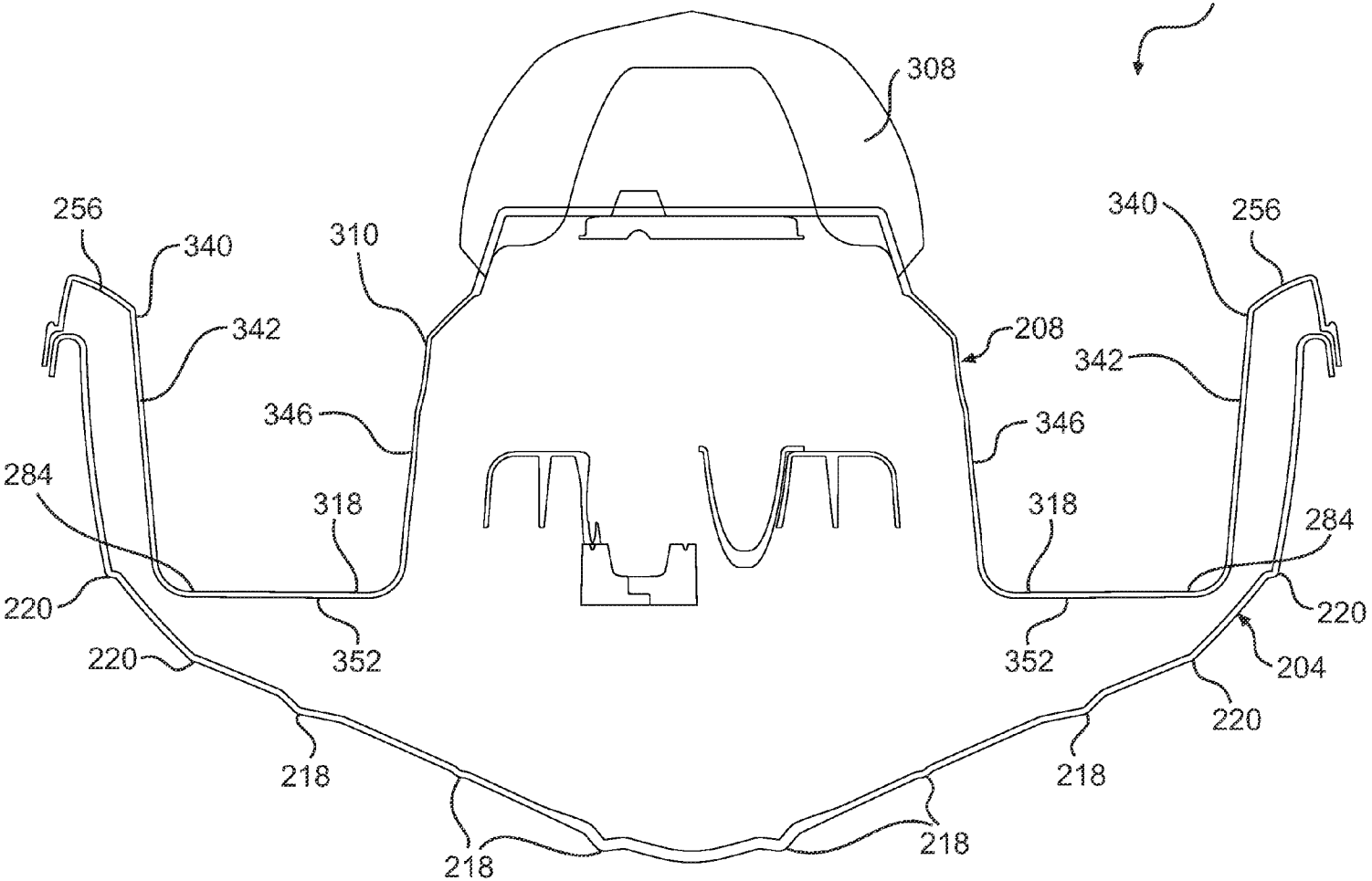
FIG. 14 is a schematic view of a transverse cross-section of a watercraft according to an alternative embodiment of the invention.

Referring now to FIG. 14, a watercraft 202 will be described according to a second embodiment of the invention. Many of the parts of the watercraft 202 are similar to corresponding parts of the watercraft 2, and will not be shown or described in detail. The watercraft 202 appears substantially similar to the watercraft 2 when viewed from the top (FIGS. 5 and 11) with the exception that the watercraft 202 has no seal 120 because the sub-deck 6 and deck 8 of the watercraft 2 are formed integrally as the deck 208 of the watercraft 202.

The watercraft 202 has two main parts. These parts are the hull 204 and the deck 208. The hull 204 and the deck 208 are joined together, preferably by an adhesive, to form the body of the watercraft 202. Rivets or other fasteners may also join the hull 204 and deck 208. Unlike the watercraft 2, the watercraft 202 has no sub-deck between the hull 204 and the deck 208. The volume between the hull 204 and the deck 208 forms the engine compartment, which functions similarly to the engine compartment of the watercraft 2. A pedestal 310 formed in the deck 208 accommodates the internal components of the watercraft 202, such as the engine (not shown), and shields these components from water. The hull 204 is provided with a combination of strakes 218 and chines 220, which respectively function similarly to the strakes 18 and chines 20 of the watercraft 2. The deck 208 has a pair of generally upwardly extending gunnels 256, that function similarly to the gunnels 56 of the watercraft 2.

The deck 208 supports a centrally positioned straddle-type seat 308 placed on top of the pedestal 310 to accommodate the driver and passengers in a straddling position. Left and right footrests 318 designed to accommodate the driver's and passengers' feet are disposed on the deck 208 on either side of the pedestal 310, between the pedestal 310 and the gunnels 256. The footrests 318 are formed by the bottom walls 352 of the left and right side channels 284, and are disposed between the respective side walls 346 of the pedestal 310 and the forward portions 342 of the respective inner walls 340 of the gunnels 256. The footrests 318 are preferably covered by carpeting made of a rubber-type material to provide additional comfort and feet traction.

Referring now to FIGS. 1, 3-5 and 8-12, the watercraft 202 has a deflector 140 disposed on a forward portion of the deck 208, similar to the deflector 140 of the watercraft 2. The deflector 140 of the watercraft 202 operates in the same manner as the deflector of the watercraft 2, and will not be described again in detail.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A personal watercraft comprising:

a hull;

a sub-deck disposed on the hull, the hull and sub-deck together forming a hull and sub-deck (HSD) assembly;

an engine disposed in the HSD assembly;

a propulsion system connected to the hull and operatively connected to the engine;

a deck disposed above the sub-deck, the deck having a pedestal;

a straddle-type seat disposed on the pedestal;

a helm assembly operatively connected to the propulsion system and disposed at least in part forwardly of the straddle-type seat; and a deflector disposed on the HSD assembly and extending outwardly therefrom, the deflector being disposed at least in part forwardly of a forward-most portion of the deck, the deflector extending laterally along a majority of the width of the HSD assembly.

2. The personal watercraft of claim 1, the HSD assembly further including:

upwardly-extending left and right gunnels; and at least one recessed portion at least partially defined by the gunnels, the at least one recessed portion being disposed lower than an upper edge of the gunnels;

wherein the deflector is disposed at least in part forwardly of the at least one recessed portion.

3. The personal watercraft of claim 1, wherein the deflector is disposed at least in part in front of the helm assembly.

4. The personal watercraft of claim 1, wherein the deflector has an upper end and a lower end, the upper end being disposed at least in part forwardly and upwardly of the lower end.

5. The personal watercraft of claim 1, wherein the HSD assembly further includes a recessed portion disposed at least in part forwardly of the pedestal of the deck; wherein the deflector is disposed at least in part forwardly of the recessed portion.

6. The personal watercraft of claim 5, wherein the deflector extends laterally along substantially an entire width of the recessed portion.

7. The personal watercraft of claim 1, wherein the deflector has an arcuate profile when viewed from the top.

8. The personal watercraft of claim 1, wherein the deflector is disposed on the sub-deck.

9. A personal watercraft comprising:

a hull;

a deck disposed on the hull, the hull and the deck forming an engine compartment therebetween;

an engine disposed in the engine compartment;

a propulsion system connected to the hull and operatively connected to the engine;

a pedestal formed in the deck;

a straddle-type seat disposed on the pedestal;

a helm assembly operatively connected to the propulsion system and disposed at least in part forwardly of the straddle-type seat;

a hood pivotably attached to the deck forwardly of the helm assembly, the hood being pivotable between an open position and a closed position for selectively providing access to a storage bin; and a deflector disposed on the deck and extending outwardly therefrom, the deflector being disposed at least in part forwardly of the hood, the deflector extending laterally along a majority of the width of the deck.

10. The personal watercraft of claim 9, the deck further including:

upwardly-extending left and right gunnels; and at least one recessed portion at least partially defined by the gunnels, the at least one recessed portion being disposed lower than an upper edge of the gunnels;

wherein the deflector is disposed at least in part forwardly of the at least one recessed portion.

11. The personal watercraft of claim 9, wherein the deflector has an upper end and a lower end, the upper end being disposed at least in part forwardly and upwardly of the lower end.

12. The personal watercraft of claim 9, wherein the deck further includes a recessed portion disposed at least in part forwardly of the pedestal; wherein the deflector is disposed at least in part forwardly of the recessed portion.

13. The personal watercraft of claim 12, wherein the deflector extends laterally along substantially an entire width of the recessed portion.

14. The personal watercraft of claim 9, wherein the deflector has an arcuate profile when viewed from the top.

* * * * *